US008870186B2

(12) United States Patent
Hoang et al.

(10) Patent No.: US 8,870,186 B2
(45) Date of Patent: Oct. 28, 2014

(54) SEAL ASSEMBLY FOR A CASING HANGER

(75) Inventors: Chau Hoang, Houston, TX (US); Khanh Anh Duong, Houston, TX (US); William Ryan Moore, Houston, TX (US); Karl A. Parfrey, Houston, TX (US); Clayton Griffin, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 0 days.

(21) Appl. No.: 13/596,544

(22) Filed: Aug. 28, 2012

(65) Prior Publication Data

US 2014/0062025 A1 Mar. 6, 2014

(51) Int. Cl.
*E21B 33/04* (2006.01)

(52) U.S. Cl.
USPC ..... 277/324; 277/327

(58) Field of Classification Search
USPC ..... 277/314, 322, 323, 324, 327
See application file for complete search history.

(56) References Cited

U.S. PATENT DOCUMENTS

| | | | | |
|---|---|---|---|---|
| 2,798,747 | A | 7/1957 | Auer | |
| 3,422,721 | A * | 1/1969 | Yonkers | 411/369 |
| 4,975,008 | A * | 12/1990 | Wagner | 411/337 |
| 5,024,453 | A | 6/1991 | Suggs | |
| 5,555,771 | A * | 9/1996 | Kuroiwa et al. | 74/89.4 |
| 5,645,282 | A * | 7/1997 | Belter | 277/598 |
| 5,921,559 | A * | 7/1999 | Aihara | 277/651 |
| 6,236,128 | B1 * | 5/2001 | Dragash, Jr. | 310/85 |
| 6,488,084 | B1 | 12/2002 | Borak, Jr. | |
| 6,582,172 | B2 * | 6/2003 | Nickerson et al. | 411/371.1 |
| 7,128,143 | B2 | 10/2006 | Van Bilderbeek | |
| 7,360,592 | B2 | 4/2008 | McMahan | |
| 7,500,409 | B2 * | 3/2009 | Yatsushiro et al. | 74/89.4 |
| 7,650,806 | B2 * | 1/2010 | Tsukada et al. | 74/89.44 |
| 7,740,061 | B2 | 6/2010 | Van Bilderbeek et al. | |
| 8,201,832 | B2 | 6/2012 | Kocurek | |
| 8,246,052 | B1 * | 8/2012 | Marvel, III | 277/331 |
| 2008/0115928 | A1 | 5/2008 | Cherewyk | |
| 2011/0061857 | A1 | 3/2011 | White | |
| 2011/0268416 | A1 * | 11/2011 | Shimirak et al. | 385/135 |

FOREIGN PATENT DOCUMENTS

| | | |
|---|---|---|
| GB | 2271793 | 4/1994 |

* cited by examiner

*Primary Examiner* — Gilbert Lee
(74) *Attorney, Agent, or Firm* — Bracewell & Giuliani LLP

(57) ABSTRACT

A seal assembly for use with a casing hanger that includes a pair of split rings held together by a threaded fastener. Torqueing the fastener axially compresses one of the rings so that it expands radially inward into sealing engagement with a wall of wellbore casing, and radially outward against an inner wall of a wellhead housing. Support grommets are provided where the fastener enters and exits the compressible ring. Protrusions on a side of the support grommets project into the compressible ring and create a sealing interface between each support grommet and compressible ring. O-rings line inner circumferences of the support grommets to seal between the support grommets and fasteners. A threaded end on a lower end of the fastener has a diameter less than an inner diameter of the O-rings to prevent damaging the O-rings during assembly.

12 Claims, 3 Drawing Sheets

SEAL ASSEMBLY FOR A CASING HANGER

BACKGROUND

1. Field of Invention

The present disclosure relates in general to a seal assembly for use with a casing hanger having rings with an axial bore to receive fasteners therein and protrusions on a side of the ring to seal between the ring and an adjacent elastomeric compression seal.

2. Description of Prior Art

Wellbores for producing hydrocarbons typically include a wellhead housing mounted on surface over the wellbore. A length of casing usually lines the walls of the wellbore and is supported by a hanger mounted to the wellhead housing. Casing hangers on land based wells generally include wedge shaped slips for coupling with the casing. Seal assemblies for preventing pressure communication are often inserted between the casing and wellhead housing. Generally, such seal assemblies include coaxial rings coupled together with threaded studs. The studs are typically torqued an amount that causes at least one of the rings to axially compress and radially expand into sealing engagement with both the casing and wellhead housing. However, the stresses introduced into the ring distorts the bore in which the stud is inserted thereby introducing leak paths between the walls of the bore and the stud.

SUMMARY OF THE INVENTION

Disclosed herein is an example of a seal assembly for use with a casing hanger. In one example the seal assembly includes an upper ring, a lower compressible ring coaxially disposed with the upper ring, a bore axially extending through the upper ring and compressible ring, an elongated fastener inserted in the bore, and an annular support grommet on a surface of the compressible ring. The support grommet has an aperture that registers with the bore, and also has a protrusion projecting into the compressible ring. The protrusion extends into the compressible ring when the fastener is torqued to axially compress the lower compressible ring. A sealing interface is formed between the support grommet and the lower compressible ring along the protrusion. Optionally, the upper ring is made of metal and the lower compressible ring includes an elastomer. In an alternate embodiment, the upper ring and lower ring each are made up of semi-circular portions that join along a diagonal interface. The annular support grommet can change from a substantially circular shape to an oval shape when the fastener is torqued. Further optionally included is an O-ring in sealing contact between the fastener and inner surface of the support grommet. In this example, the annular support grommet is a first support grommet and a second support grommet is included on a side of the lower compressible ring opposite the first grommet; also, an O-ring is between an inner surface of the second support grommet and the fastener. The fastener may optionally include threads on a lower end, and wherein each of the O-rings has an inner diameter that is greater than an outer diameter of the threads on the lower end of the fastener. In an example, the lower end of the fastener attaches to a hanger body disposed on a lower end of the lower compressible ring. A nut may be threadingly engaged on an upper end of the fastener. In an optional embodiment, an annular expansion ring is compressed between the nut and the upper ring, wherein axially spaced apart slots are provided along a portion of a circumference of the annular expansion ring that extend radially through the annular expansion ring.

Also provided herein is a method of sealing between a wellhead housing and a casing. In one example the method includes positioning an upper seal ring having axial bores onto a lower seal ring having axial bores, registering the axial bores on the upper seal ring with the axial bores on the lower seal ring, providing annular grommets each having an axial aperture and a ridge circumscribing the aperture, positioning the annular grommets substantially coaxial with the axial bores on the lower seal ring and so that the ridges contact the lower seal ring, and using a threaded fastener to couple together the upper and lower seal rings to define a seal assembly and so that the ridges protrude into the lower seal ring and form a sealing interface between each of the annular grommets and the lower seal ring. The threaded fastener can include an elongate member having threads on an upper and a lower end. In an example the method further includes threadingly engaging a nut with an upper end of the threaded fastener and threading the lower end of the threaded fastener into a hanger body, wherein tightening the nut compresses the lower seal ring. Belleville washers can optionally be provided on the fasteners between the nuts and upper ring. O-rings may also be used to seal between the threaded fasteners and the grommets.

BRIEF DESCRIPTION OF DRAWINGS

Some of the features and benefits of the present invention having been stated, others will become apparent as the description proceeds when taken in conjunction with the accompanying drawings, in which.

Figure 1:
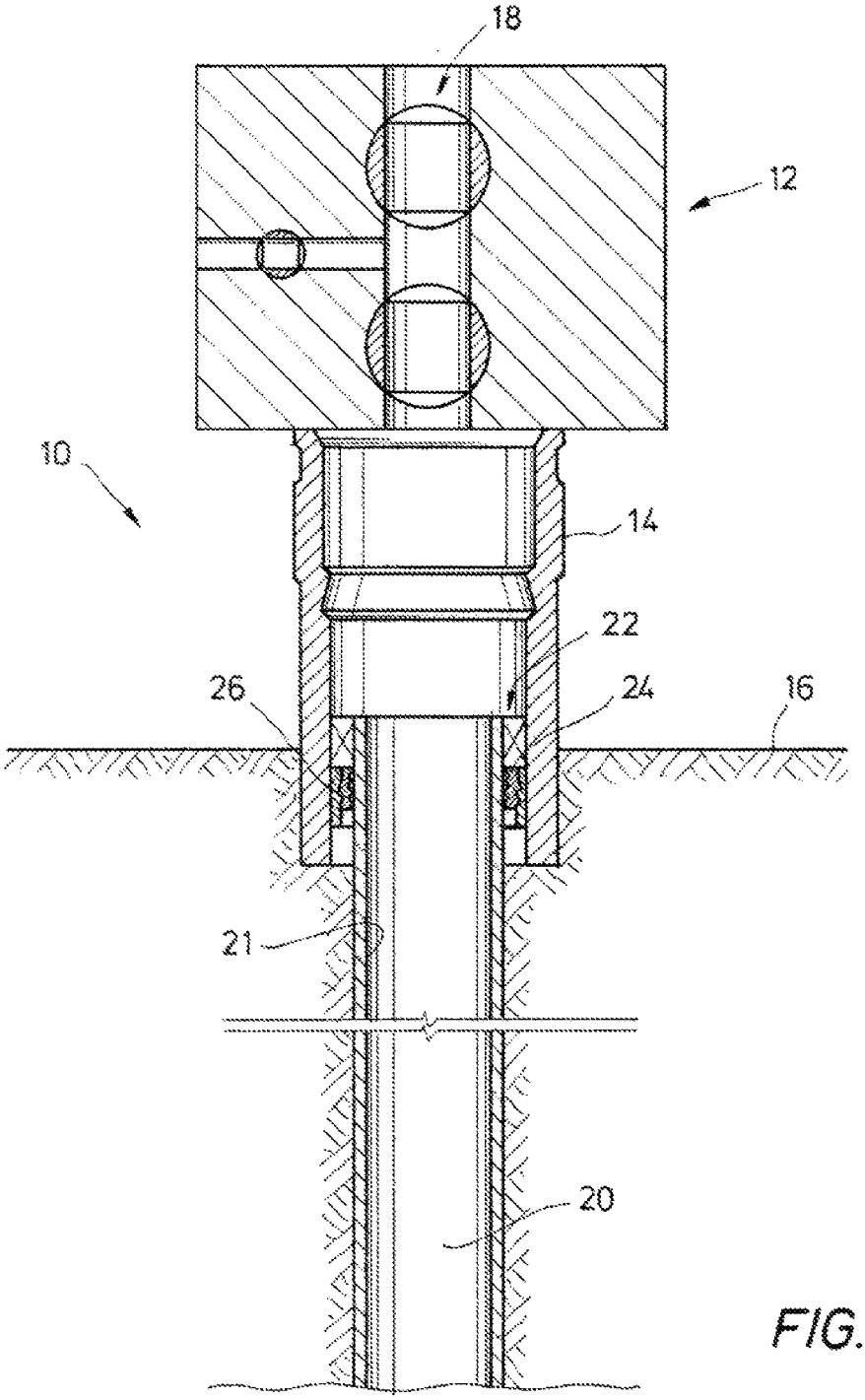
FIG. 1 is a side sectional view of an example embodiment of a wellhead assembly with a casing hanger seal assembly in accordance with the present invention.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

FIG. 1 illustrates an example embodiment of a wellhead assembly 10 in a side partial sectional view. The wellhead assembly 10 includes a production tree 12 mounted on a wellhead housing 14, where a lower end of the housing 14 is mounted in a subterranean formation 16. The production tree 12 includes an axial main bore 18 that projects downward through the wellhead housing 14, and is in communication with a wellbore 20 that is drilled through the formation 16 below the wellhead assembly 10. Casing 21 is shown lining the wellbore 20 that is supported on its upper end inside the wellhead housing 14. A seal assembly 22 provides a sealing function between the casing 22 and wellhead housing 14. The seal assembly 22 mounts onto a hanger body 24 that, in conjunction with slips 26, engages the casing 21 with the wellhead housing 14.

Figure 2:
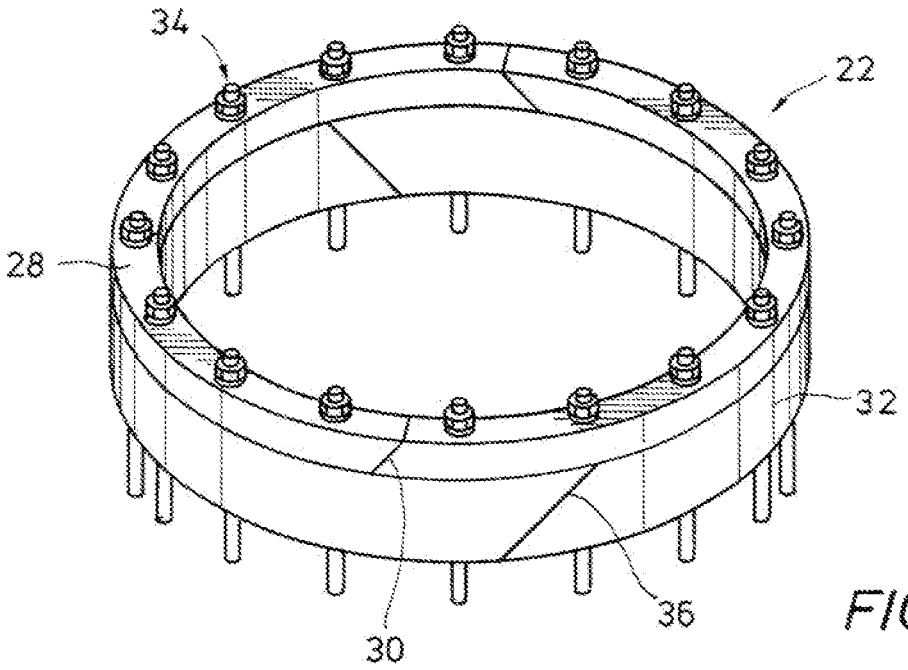
FIG. 2 is a side perspective view of the casing hanger seal assembly of FIG. 1 in accordance with the present invention.

A side perspective view of the seal assembly 22 is provided in FIG. 2. In this example, the seal assembly 22 is shown made up of an annular top seal plate 28. The top seal plate 28, or upper ring, is formed by joining together a pair of semi-circular members whose interfaces define diagonally-shaped splits 30 along a circumference of the seal plate 28. The top seal plate 28 as shown is coaxially mounted onto a compression seal 32. The compression seal 32, like the top seal plate 28, is bisectional with its semi-circular members joined together along a diagonal split 36. Example materials for the upper or top seal plate 28 include highly elastic materials, such as carbon steel or stainless steel, whereas the compression seal 32 can be made from an elastomer. One example of an elastomer includes hydrogenated nitrile butadiene rubber (HNBR). Axial fasteners 34 are illustrated coupling the top seal plate 28 onto the compression seal 32.

Figure 3:
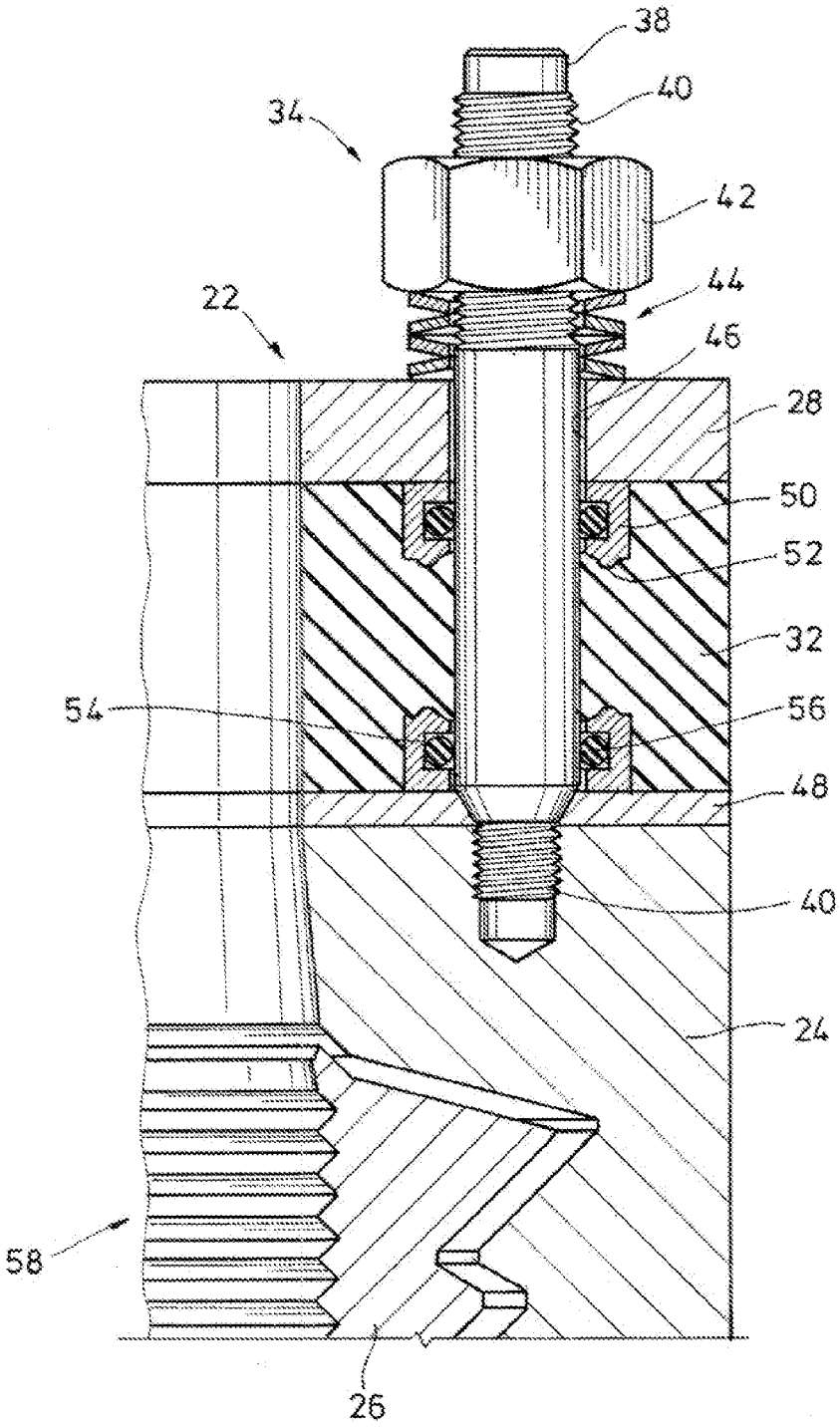
FIG. 3 is a side sectional view of the casing hanger seal assembly of FIG. 1 in accordance with the present invention.

FIG. 3 is a partial sectional view of the seal ring 22 of FIG. 2 shown mounted onto the hanger body 24 of FIG. 1. The sectional view is taken along a circumference of the seal assembly 22. As illustrated in FIG. 3, the fasteners 34 each include an elongated stud 38 shown having threads 40 on its upper and lower ends. A nut 42, having threads on an inner surface, engages the threads 40 of the upper end. Tightening the nut 42 onto the threads 40 compresses a stack of Belleville washers 44 between the nut 42 and top seal plate 28. The stud 38 inserts into an axial bore 46 shown projecting through the top seal plate 28, compression seal 32, and a bottom seal plate 48; where the bottom seal plate 48 is shown set on an end of the compression seal 32 opposite the top seal plate 28.

A pair of grommet-like support rings 50 are shown set in respective cylindrical spaces formed around the bore 46 at the upper and lower ends of the compression seal 32. In the example of FIG. 3, each support ring 50 includes a protrusion 52 that circumscribes the bore 56 on the surface of each support ring 50 facing into the compression seal 32. The support rings 50 further include a recess 54 that is a groove-like space formed on the inner circumference of each of the support rings 50. An O-ring 56 is shown set within each of the recesses 54 that extends radially inward into contact with an outer surface of the stud 38. In one example of operation, rotating the nut 42 about the threads 40 exerts a compression force to urge the support rings 50 into the compression seal 32 so that the ridges 52 protrude into the compressible compression ring 32 and define a sealing interface between the support rings 50 and compression seal 32. Further, the presence of the O-rings 56 blocks pressure communication between the O-ring 56 and stud 38. Further illustrated in the example of FIG. 3 is that the radially inward side of the slip 26 has a series of ridges 58 for gripping against an outer surface of the casing 21 (FIG. 1).

Figure 4:
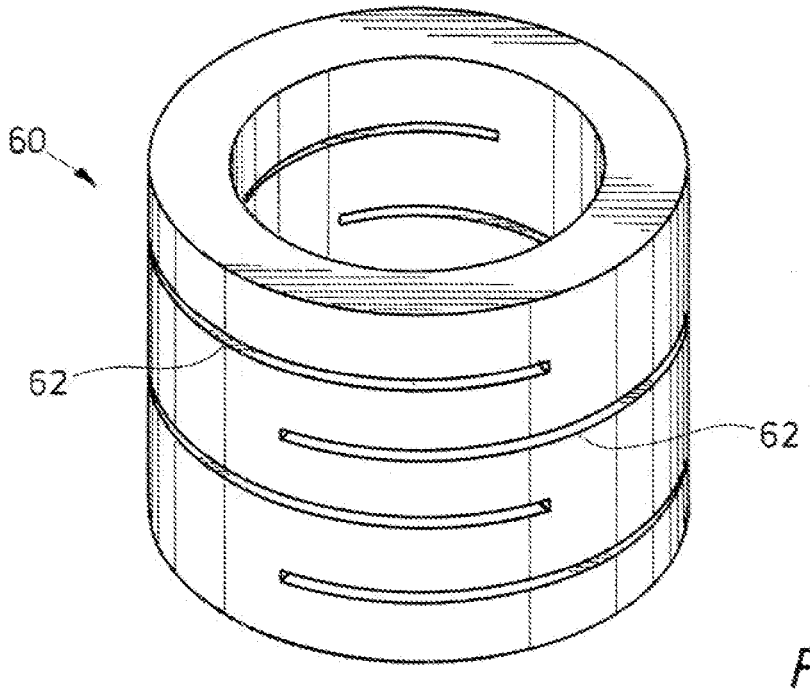
FIG. 4 is a side perspective view of an embodiment of a thermal expansion ring for optional use with the casing hanger seal assembly of FIG. 1 in accordance with the present invention.

An optional expansion ring 60 is shown in a side perspective view in FIG. 4. The expansion ring 60 includes slots 62 that extend through the body of the expansion ring 60 from the outer surface of the expansion ring 60 into an inner surface. The presence of the slots allows selective axial compression and expansion of the expansion ring 60. In one example of the device disclosed herein, the expansion ring 60 is used in lieu of the Belleville washers 44 (FIG. 4) or in combination with the Belleville washers 44. In an example, the Belleville washers 44 or expansion ring 60 can expand and/or contract in respond to thermal expansion within the stud 38, other elements of the seal assembly 22, or the hanger body 24. The resiliency of either the Belleville washers 44 or expansion ring 60 can maintain an axial stress in the stud 38 over a temperature range so that the seal assembly 22 continues to seal in spite of thermal variances.

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

What is claimed is:

1. A seal assembly for use with a casing hanger comprising:

an upper ring;

a lower compressible ring coaxially disposed with the upper ring;

a bore axially extending through the upper ring and compressible ring;

an elongated fastener inserted in the bore having threads on a lower end;

first and second annular support grommets on opposing surfaces of the compressible ring, the first and second support grommets each comprising, an aperture registered with the bore and a protrusion projecting into the compressible ring, so that when the fastener is torqued to axially compress the lower compressible ring, a sealing interface is formed between the first and second support grommets and the lower compressible ring; and O-rings in sealing contact between the fastener and inner surfaces of the first and second support grommets, and that each have an inner diameter greater than an outer diameter of the lower end of the elongated fastener.

2. The seal assembly of claim 1, wherein the upper ring comprises metal and the lower compressible ring comprises an elastomer.

3. The seal assembly of claim 1, wherein the upper ring and lower ring each comprise semi-circular portions that join along a diagonal interface.

4. The seal assembly of claim 1, wherein the annular support grommet changes from a substantially circular shape to an oval shape when the fastener is torqued.

5. The seal assembly of claim 1, wherein the lower end of the fastener attaches to a hanger body disposed on a lower end of the lower compressible ring.

6. The seal assembly of claim 1, further comprising a nut threadingly engaged on an upper end of the fastener, an annular expansion ring compressed between the nut and the upper ring, wherein axially spaced apart slots are provided along a portion of a circumference of the annular expansion ring that extend radially through the annular expansion ring.

7. The seal assembly of claim 1, wherein the elongated fastener threadingly engages an upper surface of the casing hanger.

8. A method of sealing between a wellhead housing and a casing comprising:

positioning an upper seal ring having axial bores onto a lower seal ring having axial bores;

registering the axial bores on the upper seal ring with the axial bores on the lower seal ring;

providing annular grommets each having an axial aperture and a ridge circumscribing the aperture;

positioning the annular grommets substantially coaxial with the axial bores on the lower seal ring and so that the ridges contact the lower seal ring; and using a threaded fastener to couple together the upper and lower seal rings to define a seal assembly and so that the ridges protrude into the lower seal ring and form a sealing interface between each of the annular grommets and the lower seal ring, wherein the threaded fastener comprises an elongate member having threads on an upper, and threads on a lower end that extend into a threaded bore on an upper surface of a casing hanger.

9. The method of claim 8, further comprising threadingly engaging a nut with an upper end of the threaded fastener and threading the lower end of the threaded fastener into a hanger body, wherein tightening the nut compresses the lower seal ring.

10. The method of claim 9, further comprising providing Belleville washers on the fasteners between the nuts and upper ring.

11. The method of claim 8, further comprising using O-rings to seal between the threaded fasteners and the grommets.

12. A seal assembly for use with a casing hanger comprising:

an upper ring;

a lower compressible ring coaxially disposed with the upper ring;

a bore axially extending through the upper ring and compressible ring;

an elongated fastener inserted in the bore;

an annular support grommet on a surface of the compressible ring that comprises an aperture registered with the bore and a protrusion projecting into the compressible ring, so that when the fastener is torqued to axially compress the lower compressible ring, a sealing interface is formed between the support grommet and the lower compressible ring; and a nut threadingly engaged on an upper end of the fastener, an annular expansion ring compressed between the nut and the upper ring, wherein axially spaced apart slots are provided along a portion of a circumference of the annular expansion ring that extend radially through the annular expansion ring.

* * * * *